United States Patent [19]

Garlinghouse

[11] Patent Number: 4,598,209

[45] Date of Patent: Jul. 1, 1986

[54] REMOTE CONTROL ENGINE STARTER

[76] Inventor: Randy Garlinghouse, 4178 Oakshire, Berkley, Mich. 48072

[21] Appl. No.: 659,092

[22] Filed: Oct. 9, 1984

[51] Int. Cl.[4] ..... F02N 17/00

[52] U.S. Cl. ..... 290/38 C; 123/179 BG

[58] Field of Search ..... 290/38 C, 38 R, DIG. 1, 290/DIG. 3; 123/179 B, 179 BG, 179 R

[56] References Cited

U.S. PATENT DOCUMENTS

| | | | |
|---|---|---|---|
| 2,444,460 | 7/1948 | Moncrief | 290/37 |
| 2,836,732 | 5/1958 | Newlin | 290/38 |
| 2,934,055 | 4/1960 | Kennedy | 123/179 |
| 2,949,104 | 8/1960 | Davis | 123/179 |
| 3,054,904 | 9/1962 | Fuciarelli | 290/37 |
| 3,124,118 | 3/1964 | Sibert | 123/179 |
| 3,151,249 | 9/1964 | Ives | 290/38 |
| 3,220,397 | 11/1965 | Fenner | 123/179 |
| 3,248,555 | 4/1966 | Fried | 290/38 |
| 3,259,753 | 4/1966 | McWhirter | 290/38 |
| 3,357,417 | 12/1967 | Baumann | 123/179 |
| 3,530,846 | 9/1970 | Bean et al. | 123/179 |
| 3,604,005 | 9/1971 | Gilmore | 343/225 |
| 3,612,893 | 10/1971 | Gallagher | 290/38 X |
| 3,696,333 | 10/1972 | Mott | 340/52 R |
| 3,767,932 | 10/1973 | Bailey | 290/38 |
| 3,788,294 | 1/1974 | Logan | 123/179 BG |
| 3,790,806 | 2/1974 | Lessard | 290/37 |
| 3,811,049 | 5/1974 | Hildreth et al. | 290/38 |
| 3,859,540 | 1/1975 | Weiner | 290/38 |
| 3,862,429 | 1/1975 | Bucher | 290/37 |
| 4,227,588 | 10/1980 | Biancardi | 180/167 |
| 4,345,554 | 8/1982 | Hildreth et al. | 123/179 BG |

*Primary Examiner*—William M. Shoop, Jr.

*Attorney, Agent, or Firm*—Basile, Weintraub & Hanlon

[57] ABSTRACT

A remote control engine starter apparatus for remotely starting an engine. A manually operable transmitter generates a signal, which is detected by a receiver when the receiver, is activated. A timer mounted in the vehicle and connected to the engine battery provides an output at a pre-determined time which connects electrical power through an on/off switch mounted on the vehicle engine to a first relay. The first relay connects electrical power from the vehicle battery to the receiver for powering the receiver. A second relay, energized by the first relay connects power to the starter relay of the engine to provide electrical power to the starter motor of the engine when an output from the timer means and a signal from the transmitter has been detected by the receiver.

5 Claims, 1 Drawing Figure

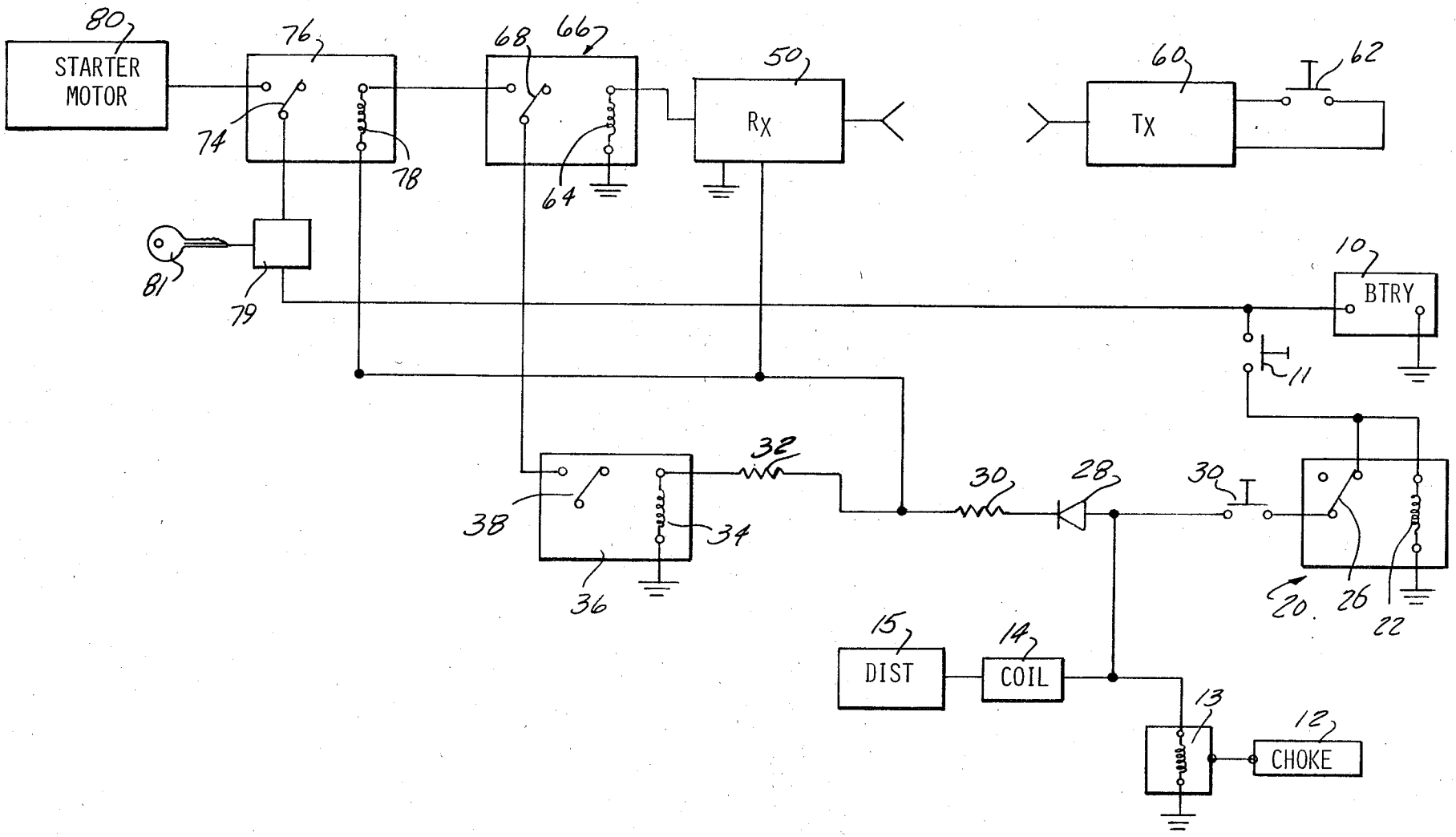
BTRY
TX
RX
CHOKE
COIL
DIST
STARTER MOTOR
10
11
12
13
14
15
20
22
26
28
30
32
34
36
38
50
60
62
64
66
68
74
76
78
79
80
81

REMOTE CONTROL ENGINE STARTER

BACKGROUND OF THE INVENTION

1. Field of the Invention

This invention relates in general, to engine starter devices and, more specifically, to remote control engine starter devices.

2. Description of the Prior Art

Engines and, in particular, internal combustion engines, are used extensively to provide power to operate devices, such as vehicles, lawnmowers, etc.

In certain occasions, it is desirable to start an engine from a location remote from the engine. This is particularly advantageous with internal combustion engines in vehicles, such as automobiles, trucks, etc. In cold weather, it is convenient to have the engine started prior to entry of the driver so as to warm the interior of the vehicle and to bring the engine to normal operating conditions before it is moved. In hot weather, it is also desirable to operate the air conditioning system of the vehicle in order to cool the interior of the vehicle prior to entry of the driver and/or passengers into the vehicle.

In order to achieve these desirable features, many attempts have been made to develop remote control engine starters. Specifically, such remote control engine starters utilize a radio frequency transmitter located remote from a vehicle, and a receiver mounted in close proximity to the engine of the vehicle. The transmitter, when activated, emits a radio frequency signal which is detected by the receiver. The receiver activates appropriate relays and solenoids to energize the starter of the engine.

Timers have also been employed in such remote control engine starters to control the amount of engine cranking time or the amount of time that the engine runs unattended before being moved. Timers have also been employed to automatically energize the transmitter and thereby activate the remote control engine starter at a pre-determined time during the day. Such timed operation is automatic and may be adjusted for any desired engine starting time.

While such previously devised remote control engine starting devices do indeed remotely start an engine and provide the desired above-listed features, they are not without deficiencies which have limited their widespread use. The majority of such previously devised control engine starter devices have been complex in construction thereby bearing a high manufacturing cost. Such stystems, also, do not provide any security against unauthorized starting of the vehicle in the case that the transmitter is stolen or used by an unauthorized individual.

Thus, it would be desirable to provide a remote control engine starter apparatus which overcomes many of the deficiencies in previously devised engine starter devices. It would also be desirable to provide a remote control engine starter which provides increased security against unauthorized starting of a vehicle.

SUMMARY OF THE INVENTION

The present invention is a remote control engine starter apparatus which finds particular advantageous use with engines used in vehicles, such as automobiles, trucks, etc. The remote control engine starter apparatus operates to remotely start a vehicle engine when the starter apparatus is activated at a pre-determined time during the day.

The starter apparatus includes a transmitter means which is located remote from the engine. The transmitter means transmits a signal when activated. A timer means is provided for generating an output at a pre-determined time during a 24-hour day. A switch means is connected to the timer means for connecting the timer means to the engine battery. Finally, the starter apparatus includes a receiver means which detects a signal from the transmitter means only when activated by an output from the timer and energizes the starter motor of the engine.

In a preferred embodiment of the remote control engine starter apparatus, a first on/off switch is connected to the transmitter for enabling a user to selectively activate the remote control engine starter. A second on/off switch is mounted on the vehicle, in conjunction with the starter apparatus itself, for placing the apparatus in an energized state. Activation of the on/off switch of the vehicle connects twelve volt power from the engine battery through the timer, when the timer has been activated at the pre-determined time of the day, to the receiver of the remote control engine starter and a second relay.

The movable contact of the second relay is connected to the movable contact of a receiver relay for applying electrical power through the movable contact of the receiver relay when the receiver relay is energized.

The receiver when energized and detecting a signal from the transmitter energizes the receiver relay thereby causing the movable contact to switch positions and connect electrical power from the vehicle battery to a starter relay which provides power to the starter of the engine to crank the engine.

The remote control engine starter apparatus of the present invention provides significant advantages over the previously devised remote control engine starter apparatus. The timer employed in the present invention is pre-setable so as to provide an output at any pre-determined time or number of times during a 24 hour period. The timer energizes the remote control starter apparatus and places it in a wait mode to detect a signal from the transmitter. The user who wishes to start the vehicle may then activate the transmitter which transmits a signal to the receiver which, as described above, causes the starter motor of the engine to be energized to start cranking of the engine.

This arrangement provides increased security since, even if the transmitter is stolen or used by an unauthorized person, the remote control engine starter apparatus can only be activated at certain pre-determined times during the day known only to the authorized user of the vehicle. Thus, the driver of the vehicle has complete control over the use of the vehicle.

The remote control engine apparatus of the present invention also makes use of conventional relays and switches which contribute to a low manufacturing cost.

BRIEF DESCRIPTION OF THE DRAWING

The various features, advantages and other uses of the present invention will become more apparent by referring to the following detailed description and drawing which illustrates a circuit diagram of the remote control engine starter of the present invention.

DESCRIPTION OF THE PREFERRED EMBODIMENTS

Referring now to the drawing, there is illustrated a remote control engine starter apparatus which provides remote starting of an engine; particularly, an internal combustion engine employed in vehicles, such as automobiles, trucks, etc.

As shown in the drawing, the remote control engine starter apparatus of the present invention is used with a conventional engine, such as can be employed in a vehicle, such as an automobile, truck, etc. Such engines typically include a battery 10 providing a source of electrical power to the ignition system of the vehicle, a choke 12 moved by a solenoid for adjusting the air/fuel mixture to the carburetor of the engine and a coil 14 which provides a high voltage charge to the distributor 15 of the engine.

The remote control engine starter apparatus of the present invention includes a timer means 20 which is connected to the battery 10 by an on/off switch 11 which selectably controls the activation of the timer 20. The switch 11 can be mounted in any convenient location, such as on the vehicle.

The timer means 20 may be any conventional type of timer which provides an output signal at a pre-setable time. Preferably, the timer 20 is a 12 hour timer which, when the pre-set time is reached, causes its normally-open, movable contact 26 to move to a closed position thereby providing an output signal. Since a 12 hour timer has been utilized, two timing periods are provided during a standard 24 hour day.

As shown in the drawing, the timer 20 includes an energizable coil 22 which is connected through the switch 11 to the battery 10 of the vehicle. When electrical current flows through the coil 22, the coil 22 causes the movable contact 26 of the timer 20 to move to a closed position. This connects the battery 10 through the switch 11 and contact 26 to one terminal of an on/-off switch 30. The on/off switch 30 is mounted in a convenient location in the vehicle.

The other terminal of the on/off switch 30 is connected to a coil 13 which controls the movement of the choke 12. The switch 30 is also connected to the coil 14 on the distributor 15 of the engine to connect electrical power to the distributor 15.

One terminal of the switch 30 is also connected through a diode 28 and a resistor 30 to a receiver means 50.

As shown in the drawing, the remote engine starter apparatus of the present invention is provided with a transmitter means 60 which is located remote from the vehicle engine. The transmitter means 60 may be of any conventional construction and, preferably, is a single band, battery powered portable unit which generates a radio frequency signal when activated. An on/off switch 62 is connected to the transmitter 60 to selectively activate the transmitter 60.

When activated, the transmitter 60 emits a radio frequency signal detectable by the receiver 50 which is tuned to the same frequency of the transmitter 60. When operative power is connected to the receiver 50 by activation of the timer means 20, as described above, and a signal is detected from the transmitter 60, the receiver 50 will generate an output signal activating a coil 64 of the receiver relay 66. Energization of the coil 64 causes the movable contact 68 of the relay 66 to move to a closed position.

A second resistor 32 is connected between the first resistor 30 and the coil 34 of a relay 36. The relay 36 has a contact 38 associated therewith which is movable between a normally open state and a closed state. When in the closed state, the contact 38 connects power from the battery 10 to the contact 68 of the receiver relay 66. The other terminal of the movable contact 68 associated with the receiver relay 68 is connected to another a third relay 76. The coil 78 of the relay 76 is energized on the application of power thereto. The coil 78 causes its contact 74 to move from its normally open position to a normally closed position thereby connecting power from the battery 10 through an ignition switch 79 activated by a conventional key 81 through the contact 74 to the starter motor 80 thereby energizing the starter motor and causing cranking of the engine.

Interposed between the battery 10 and the starter relay contact 74 is an ignition switch 79 operated by a standard ignition key 81. The key operated switch 79 enables manual operation of the starter separate from the remote control energy starter of the present invention.

Thus, it can be seen that the engine will be started only when two conditions are met; namely, the timer 20 has generated an output signal at a pre-determined time during a 12 hour period thereby activating the various control relays and applying power to the receiver 50, and the transmitter 60 has been activated such that a signal has been detected by the receiver 50 to activate the receiver relay 66 and the starter relay 58 in the manner disclosed above to apply power to the starter motor and cause cranking of the engine. This provides additional security since use of the transmitter by an unauthorized person cannot activate the remote control engine starter apparatus of the present invention unless the timer has also reached its pre-set activation time.

What is claimed is:

1. A remote control engine starter for use in remotely starting an engine including a starter motor and a battery, comprising:

transmitter means, remote from the engine, for transmitting a signal;

timer means for generating an output at a pre-determined time;

switch means for connecting the timer means to the engine battery; and receiver means, responsive to the timer means, for detecting a signal from the transmitter means and energizing the starter motor of the engine only when an output from the timer means has been generated.

2. The remote control engine starter of claim 1 further including switch means for selectively activating the transmitter means.

3. The remote control engine starter of claim 1 wherein the transmitter means and the receiver means operate at radio frequencies.

4. The remote control engine starter of claim 1 wherein the receiver means is mounted on the vehicle.

5. The remote control engine starter of claim 1 further including:

a first relay having a coil and a contact movable to a closed state when the coil is connected to a source of electrical power, the movable contact being arranged to connect electrical power from the vehicle battery to the receiver means when the first relay coil is energized.

* * * * *